US011670151B2

(12) United States Patent
Lafrance

(10) Patent No.: US 11,670,151 B2
(45) Date of Patent: Jun. 6, 2023

(54) INTEGRATED FIRE AND EMERGENCY MANAGEMENT SYSTEM

(71) Applicant: Patrick Lafrance, S-Roch de l'achigan (CA)

(72) Inventor: Patrick Lafrance, S-Roch de l'achigan (CA)

( * ) Notice: Subject to any disclaimer, the term of this patent is extended or adjusted under 35 U.S.C. 154(b) by 184 days.

(21) Appl. No.: 17/183,912

(22) Filed: Feb. 24, 2021

(65) Prior Publication Data

US 2021/0256828 A1 Aug. 19, 2021

Related U.S. Application Data

(63) Continuation-in-part of application No. 16/695,226, filed on Nov. 26, 2019, now abandoned.

(51) Int. Cl.

| | |
|---|---|
| ***G08B 19/00*** | (2006.01) |
| ***G08B 17/06*** | (2006.01) |
| ***G08B 17/02*** | (2006.01) |
| ***G08B 21/18*** | (2006.01) |
| ***G08B 21/02*** | (2006.01) |
| ***G08B 17/10*** | (2006.01) |

(52) U.S. Cl.

CPC ..... *G08B 19/005* (2013.01); *G08B 17/02* (2013.01); *G08B 17/06* (2013.01); *G08B 17/10* (2013.01); *G08B 21/02* (2013.01); *G08B 21/185* (2013.01); *G08B 21/187* (2013.01)

(58) Field of Classification Search

CPC ..... G08B 19/005; G08B 17/02; G08B 17/06; G08B 17/10; G08B 21/02; G08B 21/185; G08B 21/187

See application file for complete search history.

(56) References Cited

U.S. PATENT DOCUMENTS

| | | | |
|---|---|---|---|
| 5,832,187 | A | 11/1998 | Pederson et al. |
| 5,977,872 | A | 11/1999 | Guertin |
| 10,785,586 | B2 | 9/2020 | Liu et al. |

*Primary Examiner* — Kam Wan Ma

(57) ABSTRACT

An integrated fire and emergency management system comprised of standard emergency devices wherein each device is equipped with a sensing device configured for detecting and reporting to a server, by way of a transceiver, to a Central Management Software which connects to the Internet and all manner of private networks. The devices include alarm bells, extinguishers, manual alarm stations, battery-backed emergency lights which also comprise infrared, smoke, and motion detectors, sprinklers from a sprinkler system, smoke detectors (6 in 1), a display screen for displaying evacuation instructions, and light strips along the walls to indicate the best exit route. The 6-in-1 smoke detectors send their readings to the server where the Central Management Software has an algorithm that determines the best evacuation route that minimizes exposure to smoke and noxious gases.

1 Claim, 8 Drawing Sheets

10
19
20
20
40
18
12

INTEGRATED FIRE AND EMERGENCY MANAGEMENT SYSTEM

CROSS-REFERENCE TO RELATED APPLICATIONS

The present application claims priority to US application Ser. No. 16/695,226 filed Nov. 26, 2019 which itself claims priority to United Kingdom Patent Application serial number GB1819222.9 filed on Nov. 26, 2018 entitled "Integrated fire and emergency management system", the disclosure of which is hereby incorporated in its entirety at least by reference.

BACKGROUND OF TRE INVENTION

1. Field of the Invention

The present invention relates generally to fire and emergency equipment, but more particularly to an integrated fire and emergency management system.

2. Description of Related Art

Fire safety is a major concern in large buildings. Despite all sprinklers, fire extinguishers, marked outlets, alarms, etc. Besides having equipment that complies with regulations. It is important to have access to the status of the emergency situation, such as a fire, for example, so that firefighters, can better assess the situation. Also, for the work of preventionists and city inspector, there is a need for a better centralized system which makes it easy to evaluate and check the functionality of the system. In larger buildings most of the time, there must be someone who checks all the fire safety. There is a need for an intelligent fire safety makes it possible to be above the norm by offering the possibility of being able to check the security system in real time. It is also possible to be able to generate reports ULC and NFPA, and thus to consult the state of the emergency network.

BRIEF SUMMARY OF THE INVENTION

It is a main object of the present disclosure to provide for an integrated fire and emergency management system.

In order to do so, there is provided a system comprised of standard emergency devices wherein each device is equipped with a sensing device configured for detecting and reporting to a server, by way of a transceiver, to a Central Management Software which connects to the Internet and all manner of private networks.

The devices include alarm bells, extinguishers, manual alarm stations, battery-backed emergency lights which also comprise infrared, smoke, and motion detectors, sprinklers from a sprinkler system, smoke detectors (6 in 1), a display screen for displaying evacuation instructions, and light strips along the walls to indicate the best exit route.

The 6-in-1 smoke detectors send their readings to the server where the Central Management Software has an algorithm that determines the best evacuation route that minimizes exposure to smoke and noxious gases.

2. In a preferred embodiment, the system works in combination with a kitchen hood inside a kitchen.

3. In a preferred embodiment the system works in combination with a paint shop.

4. The integrated fire and emergency management system has system components having a number or number with letter that gives their assigned decimal identification to the system. The components send their decimal values to the secondary panels.

The secondary panels translate the decimal value into binary code for sending to the primary panel. The main panel, as well as the server, create the escape route and perform other system functions.

5. The integrated fire and emergency management has a method of operation consisting in the steps of:

a) when an alarm is triggered, all system components send the first code to be received to the secondary panel. Green or red.

b) all elevators are stopped at the next level, the fire alarm signals occupants to leave the building, and the elevator doors close and the elevators stay in place.

c) each component that has a green signal is identified with their decimal value.

d) location of each component.

e) verification of the count of each person on the floors or in the building.

f) present the correct path for a quick escape.

g) verification of the decrease in occupants in the building.

h) triggering of sprinklers in stairwells or given path to protect the exit of people.

BRIEF DESCRIPTION OF TRE SEVERAL VIEWS OF THE DRAWINGS

Other features and advantages of the present invention will become apparent when the following detailed description is read in conjunction with the accompanying drawings, in which:

FIG. 1 Schematic view of the key components of the invention.

FIGS. 2A-E Front view of a fire extinguisher with hook, hood, fire extinguisher cabinet and support Isometric view of an embodiment of the invention in the context of a corridor, with enlarged isometric views of the components forming part of the invention FIGS. 3A-C Isometric views and close-ups of components in an office building. Front view of a fire extinguisher with hook, hood, fire extinguisher cabinet and support FIGS. 4A-D Isometric and frontal view of the components to be used on a kitchen hood. Isometric views and close-ups of components in an office building.

FIGS. 5A-C Isometric view of the components to be used in a paint shop. Isometric and frontal view of the components to be used on a kitchen hood.

FIGS. 6A-B Isometric views of components in an office context. Isometric view of the components to be used in a paint shop.

DETAILED DESCRIPTION OF THE PREFERRED EMBODIMENT

Figure 1:
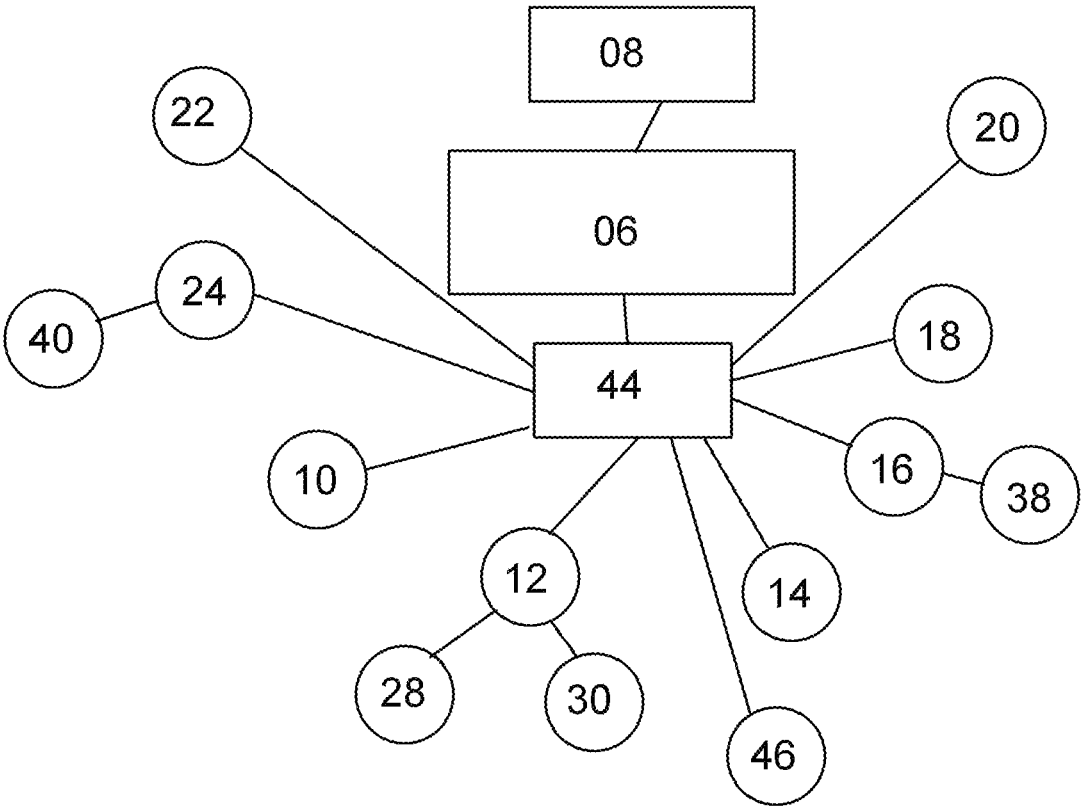
Figure 2A:
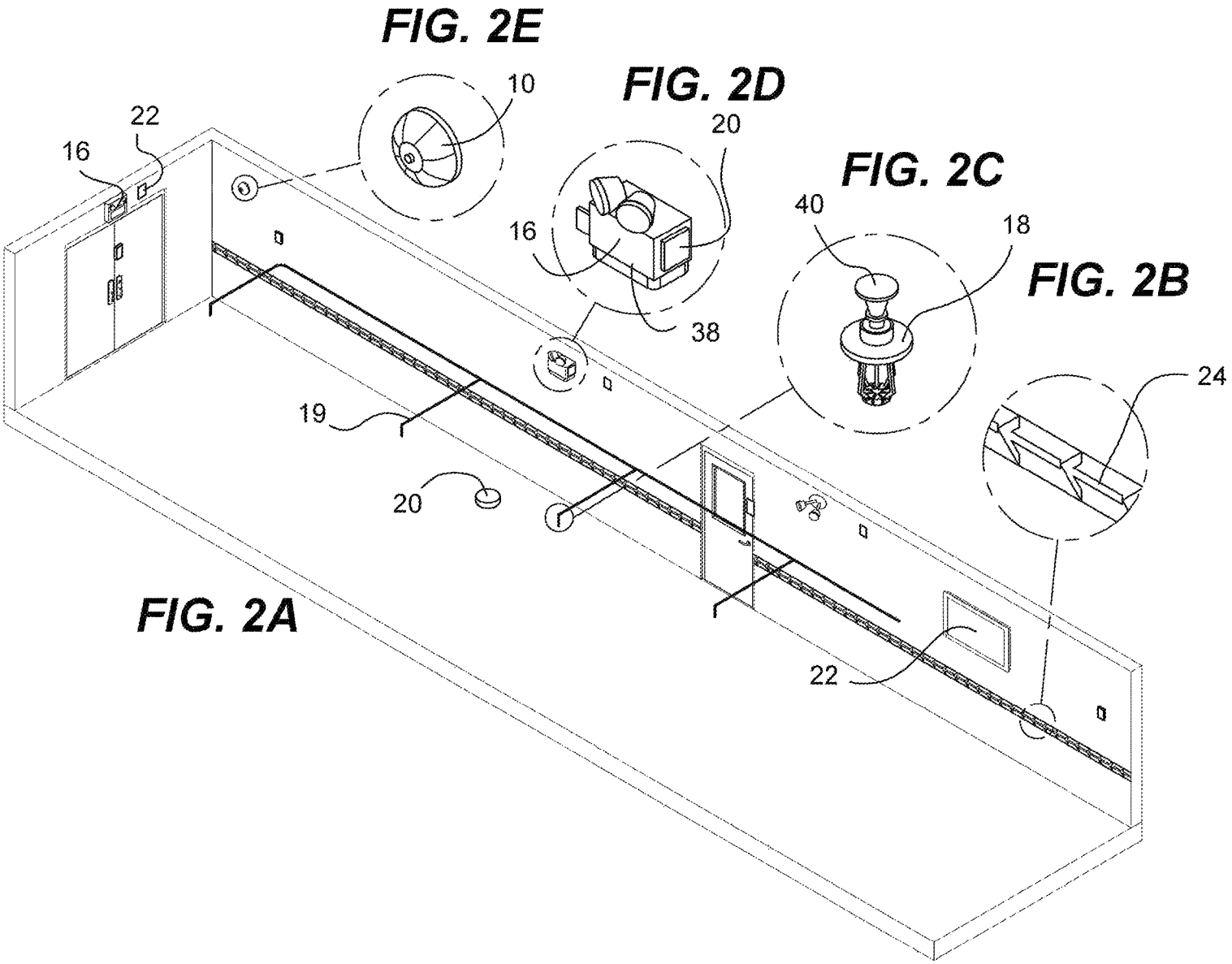
Figures 3A, 3B, 3C:
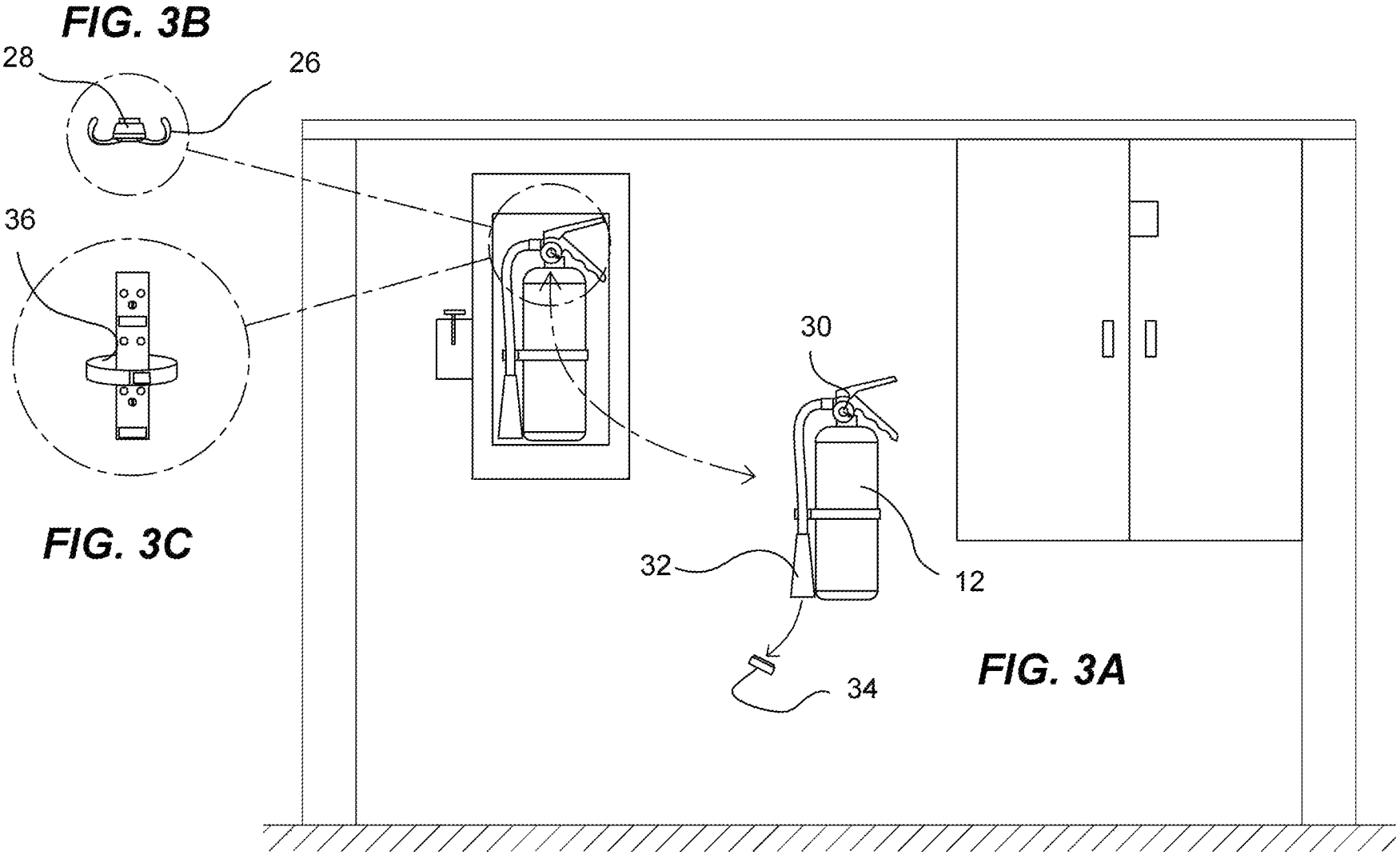

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a pulling tool for a human-powered wheeled vehicle.

Referring now to any of the FIGS. from 1 to 7, according to a first embodiment, there is provided a series of standard emergency devices in which all have been modified for optimal operation and in which all the devices are interconnected on a server (06) which manages the system by way of a Central Monitoring Software (08) which connects to the Internet and all manner of private networks. The devices include alarm bells (10), extinguishers (12), manual alarm stations (14), battery-backed emergency lights (16) which also comprises infrared, smoke, and motion detectors, sprinklers (18) from a sprinkler system (19), smoke detectors 6 in 1 (20), a display screen (22) for displaying evacuation instructions and light strips (24) along the walls to indicate the best exit route. The 6-in-1 smoke detectors (20) send their readings to the server, an algorithm that determines the best evacuation route that minimizes exposure to smoke and noxious gases.

The fire extinguisher (12) is hooked to a signal hook (26) having a switch (28) that indicates whether the fire extinguisher (12) is hooked or not. The pressure gauge (manometer) (30) sends, via Bluetooth or a similar communication protocol, an electronic signal to indicate the level of pressure in the extinguisher (12). The end of the nozzle (32) has a cap (34) which always leaves it clean and transparent for optimal operation. The fire extinguisher is fixed in a holder (36) as is known in the art. It should be noted that a similar embodiment can be installed in a vehicle.

For convenience, battery-backed emergency lights (16) can also house 6-in-1 detectors (20) and motion detectors and infrared detectors. This allows the system to know if the person is well on their way and to know that her progress is good who can send their information to the central server. A battery (38), part of the battery backup lights (16), can also send information on its charge and indicate whether its poles are clean so as to conduct electricity as best as possible.

Manual alarm stations (14), emergency lights (16), alarm buzzer (10), sprinklers (18), display screen (22), 6-in-1 smoke detectors and strip lights (24) are all connected wirelessly or wired so as to be able to communicate by means of a transceiver (44) such as a router that can handle WiFi, bluetooth, NEC and wired transmission such as LAN, for example. Obviously, this part of the technology will change as new communication protocols and hardware are invented. n integrated chip (40), their status to the server or to receive from the server information that they can display, such as for example the display screen (22) and the light strips (24).

In case of fire, the detectors 6 in 1 (20) or at least, a manual alarm station (14) is triggered, which sends an alert signal to the server. On the basis of several algorithms, the server will decide whether it is necessary to start the sprinklers (18), sound the alarm (10), and what kind of instructions to display on the display (22) and which direction the arrows should point on the light strips to direct people to the appropriate exits (40, 40'). Selected paths are selected based on the amount of heat and gas released and promote the safest exit strategy. The display screen (22) is also equipped with a loudspeaker for communicating audio messages.

Figures 4A, 4B, 4C, 4D:
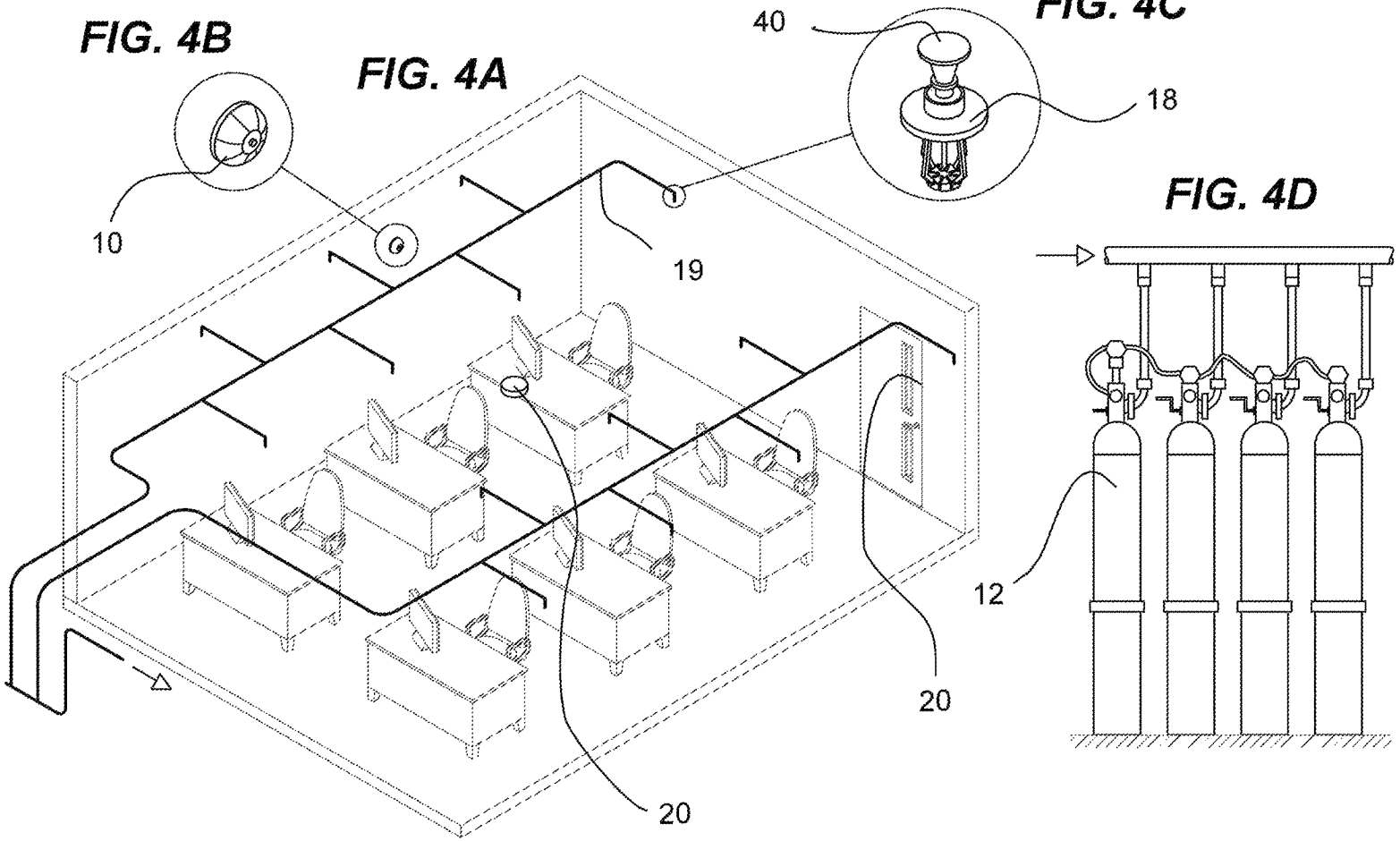
Figures 5A, 5B, 5C:
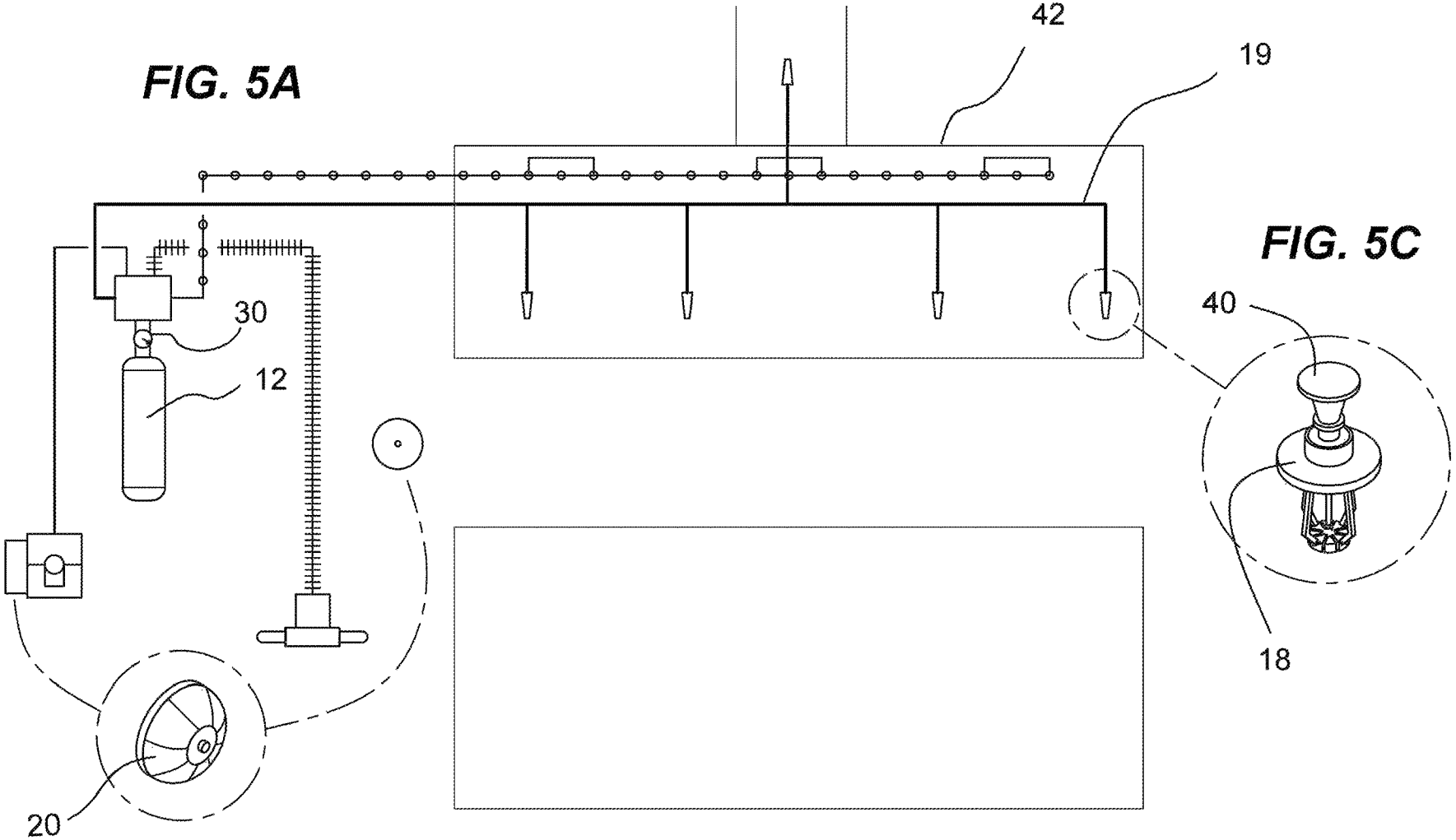
Figures 6A, 6B:
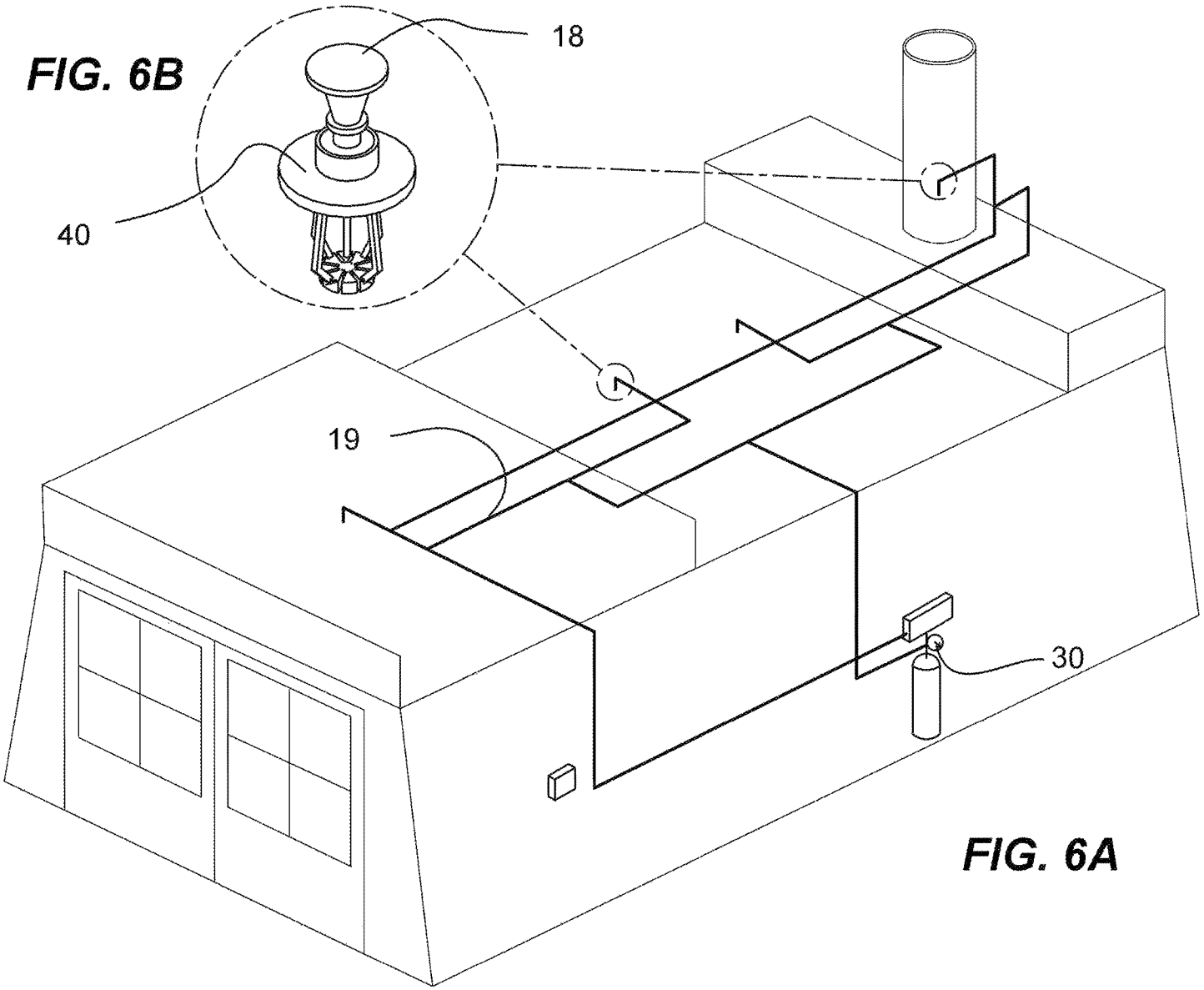
Figure 7:
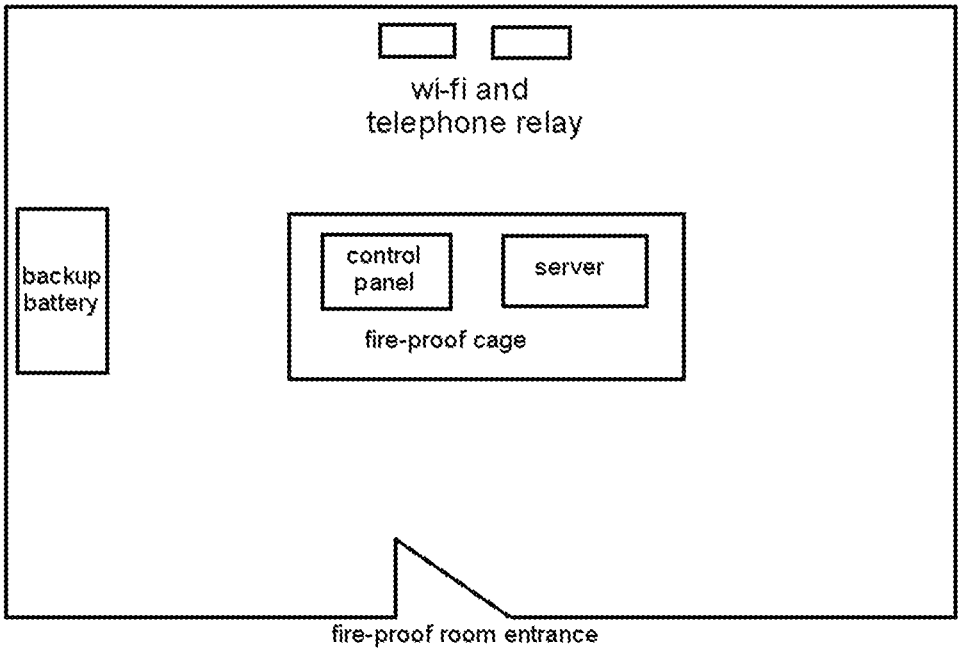
FIG. 7 is a schematic plan view of the components of the fire-proof room according to an embodiment of the invention
Figure 8:
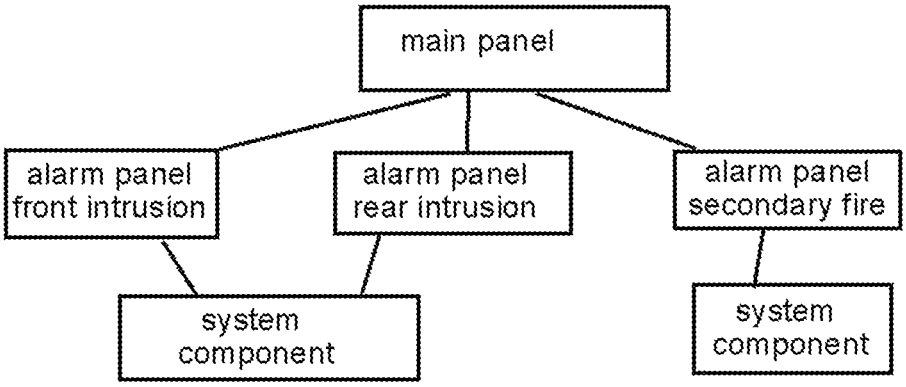
FIG. 8 is a Schematic view of the fire-proof room according to an embodiment of the present invention.

FIG. 4 shows the components used around a kitchen hood (42) as in a restaurant, for example. Other figures show the components in various contexts and environments, such as a paint shop or an office building. The same components can be used in various configurations in many such environments.

Surveillance Sensors (46):

The surveillance sensors (46) are small integrated detectors and electronic chips installed on all fire protection devices and are used for connecting to the server or web application and then to a central monitoring station. The server (06) is for big building and the web application is for small companies or private house. The method used to store and retrieve data remotely uses tags. Surveillance sensors (46) react to radio waves and transmit information remotely. The sensors (46) are part of Internet of Things (IOT) and can be used for just about anything, they work in conjunction with Artificial Intelligence (AI) software and are put in all electrical or electronic devices. They can also be used in all motor vehicles or machinery as well as a host of home automation applications to operate or program the lights, start the washer or dryer, the dishwasher, the oven, can also be used to program the outside lights, can also be used to program the spa or pool, open or close the heating Etc. All accessible from the cell phone or via the Internet.

Current sensors (46): detects the presence or absence of current and indicates it to the central monitoring station and the web application.

Fire Sensors (46): Detect bad current voltages that cause a fire.

Corrosion or rust sensors (46): They are equipped with an alarm that triggers in case of corrosion or rust on the terminals or connections. This triggers as soon as the electrical contact is bad.

Water Leak Sensors (46): They are equipped with an alarm that triggers in case of pressure drop in the pipes. This triggers as the pressure decreases.

Sprinkler head sensors (26): These are equipped with an alarm that triggers in the event of corrosion or rust on the nozzle heads and the trigger breaks in the event of a fire. They also trigger in case of fire. Can give as much information as possible before a fire triggers or other risk of damage.

Wireless Door and Window Sensors (46)

Motion sensor (46): Contact will detect the movement of a moving window or door.

Glass breakage sensor (46): detects windows that break.

Bluetooth connection, Internet connection, Telephone network connection: The connection of the bell is done by Bluetooth, Internet (WiFi) and telephone network card depending on the situation.

Motion sensor (46): Detects the direction of a person to take in case of fire that is given by the server and can also be used to detect an intruder when the building burglar alarm is active.

Thermal sensor (46): The infrared thermal sensor ensures that unconscious people are reported, and infrared night vision allows monitoring in case of smoke. Detects the direction of a person to take in case of fire that is given by the server and can also be used to detect an intruder when the burglar alarm of the building is active.

Extinguisher

Possible Types of Extinguishers:

ABC, BC, CO2, automatic fire extinguisher system, K-guard, pressurized water, etc.

Intelligent Manometer (30): The manometer has a monitoring chip that triggers an alarm in case of insufficient pressure.

Protective cap: A protective cap on the end of the hose is added to prevent clogging.

Alarm: Ringing against the theft of the fire extinguisher. It is connected to an alarm in case of theft. As soon as the extinguisher is unhooked the alarm is triggered and can indicate to the central that there may have a small fire problem.

Hose clip: The hose clip is soldered to the body of the fire extinguisher.

Light: A flashing light activates in the event of an anomaly.

Bluetooth connection, Internet connection, Telephone network connection: The connection of the extinguisher is done by Bluetooth, Internet (WiFi) and telephone network card depending on the situation.

Hook 2.0

Possible Sorts of Hooks:

Wall mounted 2.5 lbs, 5 lbs, 10 lbs and 20 lbs and 2.5 lbs and 5 lbs vehicle bracket.

Wall Hook:

Sensor against theft (46): It is connected to an alarm in case of theft. As soon as the extinguisher is unhooked the alarm is triggered and can indicate to the central that there may be a fire.

Hole for aiming hook: The part of the hook that is used to fix it to the wall is elongated and the fixing holes are more spaced.

Hole to retract fire extinguisher: The end of the hook that supports the fire extinguisher is straight rather than curved to facilitate installing.

Hook that has a tip to enter the fire extinguisher: The tip end is rounded and smaller so that it can be used for all kinds of fire extinguisher.

Monitoring sensors (46): Connected to all the devices, in non limiting example, devices (12, 14, 16, 18, 20, 22, 24, 26, 28, 30, 38) and relaying to the interface (44) and then the server (06).

2.5 Lbs and 5 Lbs Vehicle Bracket

Sensor against theft (26): It is connected to an alarm in case of theft. As soon as the extinguisher (12) is unhooked the alarm is triggered and can indicate to the central who may have a small fire problem.

Holes for hanging the hook: The part of the hook that is used to fix it to the wall is elongated and the fixing holes are more spaced.

Holes to retract the fire extinguisher: The end of the hook that supports the fire extinguisher is straight rather than curved to facilitate installing.

The tip end of the hook is rounded and smaller so that it can be used for all kinds of fire extinguisher.

Fire extinguisher bracket attachment pin: The tie pin is welded for strength.

Fastening strip: The fastening strip is welded to the support and goes around the fire extinguisher. A clip and an additional band provide more strength.

Fastener and tape: put two fasteners and two fastener strips.

Monitoring sensor (46): The monitoring sensor serves for connection to the central monitoring software (08).

Vehicle Bracket 10 Lbs and 20 Lbs

Sensor against theft: It is connected to an alarm in case of theft. As soon as the extinguisher is unhooked the alarm is triggered and can indicate to the central that there may be a fire.

Hole for hanging hook: The part of the hook that is used to fix it to the wall is elongated and the fixing holes are more spaced.

Hole to retract fire extinguisher: The end of the hook that supports the fire extinguisher is straight rather than curved to facilitate installing.

Bracket attachment pin: The tie pin is welded for added strength.

Fire extinguisher protection: Add a small protective cabinet to protect the fire extinguisher.

Monitoring sensor: The monitoring sensor serves for connection to the central monitoring software (08).

Extinguisher Cabinet:

Sensor (46) against theft: It is connected to an alarm in case of theft. As soon as the extinguisher is unhooked the alarm is triggered and can indicate to the central that there may be a fire.

Hook: A hook has been added to support the fire extinguisher.

Hammer storage: The hammer to break the plexiglass is stored in a small box against the cabinet.

Alarm: Ringing against the theft of the fire extinguisher.

Light: A light illuminates the cabinet in case of insufficient lighting.

Light detection: They have a chip that connects them to the system and warns when the lights are burned.

Emergency Unit (Spot Light)

The unit automatically turns on in case of power failure and is a square box that will have a transparent plastic and will connect to certain emergency unit. This will give light everywhere.

Smoke detector (20): The detector is sensitive not only to smoke, but also to fumes of natural gas or propane, carbon monoxide, heat and cold. (6 in 1 detector).

Motion Detector (46): Detects a person's direction in the event of a fire and can also be used to detect an intruder when the building's burglar alarm is active.

Thermal sensor (46): The infrared thermal sensor ensures that unconscious people are reported, and infrared night vision allows monitoring in case of smoke.

Light sensor (46): They have a chip that connects them to the system and warns when the lights are burned.

Battery sensor (46) to give information about battery charge as well as corrosion or rust on the terminals or connections. This triggers as soon as the electrical contact can no longer charge the battery.

Emergency unit with exit pictogram. The unit turns on automatically in the event of a power failure. Vocal and visual alarm.

Manual Alarm Station:

The manual alarm station is digital and sits in a protective box and rings an alarm bell.

Flashing light: A light flashes to indicate evacuation.

Device for Kitchen Hoods:

Monitoring sensor (46): Detects excessive heat and/or smoke under the hood. It is comprised of the (6 in 1) smoke detector. Manometer for detecting pressure in the fire extinguisher.

Device for body shop contains all the sensors and equipment used for kitchen hood.

The system can be used in any type of building, it is designed for all exciting buildings.

Main System and Fire-Proof Chamber

The main control panel is in a fire chamber created for this purpose. So the walls have a minimum resistance, as the building code requires, lasting one hour. This room has a minimum dimension of 144 square feet to accommodate the system in place.

In this room is the main building control panel. The panel is in its own fire cage for added protection. All the wires in the building for the system terminate in this room.

There is also the wi-fi signal for the system, the telephone relay of the system, the server which helps analyze the data, and all the other major needs of the system.

Figure 9:
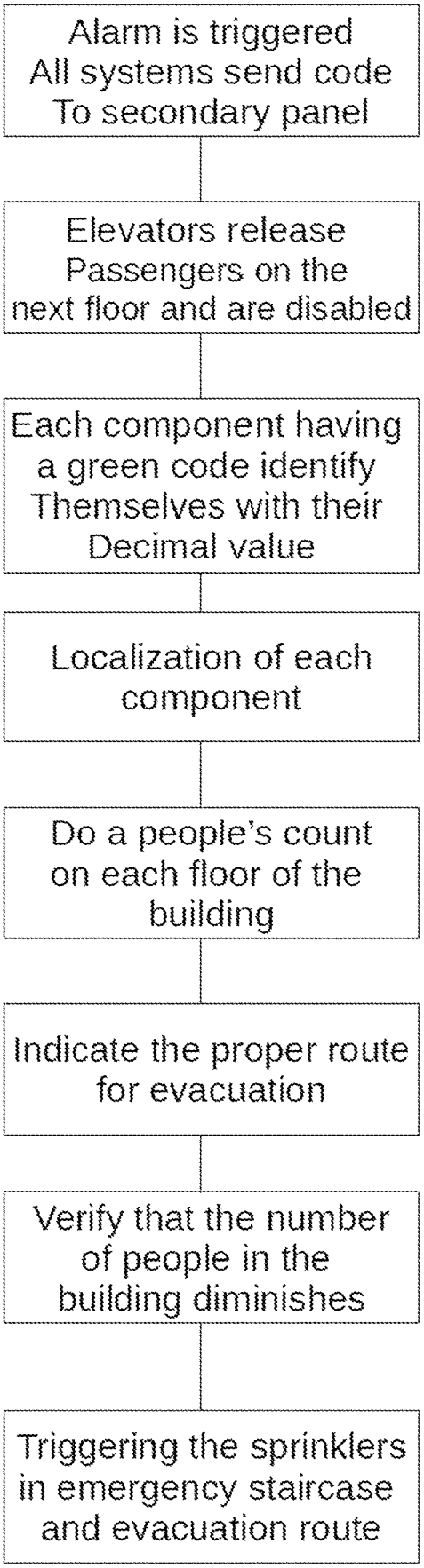
FIG. 9 is a schematic view of the hierarchy of the various panels.

FIG. 9 shows that the system occupies the fire-proof chamber in large buildings, but for smaller buildings, the central monitoring station has a structure to allow the signal relay to take place in a fire chamber. (Eg house, small shops, etc.)

Secondary Panels

Secondary panels are those that can be found in plain sight and next to front doors as the code requires. These panels are used for the fire alarm and the intrusion alarm. A secondary panel for the alarm, and two panels for the intrusion alarm (front and rear). These panels send signals either by wire or by wi-fi, or telephone relay, according to the circumstance and the need of the place.

The signal will work like this, whatever is recorded by the components will be sent to the secondary panel which will send it to the main panel and the server which are in the fire room designed for this purpose.

System Wire

All wires in the system have fire resistance. This means that all copper wires are coated in plastic having fire resistance. All these wires are then wrapped once more in a plastic sheath with fire resistance, followed by a final aluminum layer. All of these wires are hidden in the walls of the building where the system is installed.

Algorithm

Everything that is recorded by the components is sent to the secondary panel which sends it to the main panel and the server which are in the fireproof room designed for this purpose.

Decimal Value Assigned to the Components of the System

00 Green
01 Yellow
02 Red
03 Elevator
0 Smoke detector (smoke, carbon monoxide, gas, etc.)
0A: smoke
0B: carbon monoxide
0C: gas
1. Heat detector (heat, cold)
1A: beat
1B: cold
2. Manual station
3. Bell and voice signals
3A: bell
3B: voice signals
4. Motion detector, infra-red, thermal sensor
4A: motion detector
4B: infra-red
4C: thermal sensor
5. Broken door or window
5A: door
5B: window
6. Sprinkler
7. Counter of people inside the building on a floor by floor basis
8A: inside
8B: exited
9. Portable fire extinguisher
10. System under pressure
11. Kitchen hood
12. Evacuation given with a safe path
13. Sensor
14. Emergency light
15. Location of each component
16 Scanner to see if bomb in cars or on people
17 Garage door
18 Pedestrian door
000 Cellular Alert
001 TV Alert
002 Computer and tablet alert
003 Earthquake alert
004 Tsunami warning
005 Bomb threat
006 Restaurant fridge and freezer alert
26A open
26B closed
007 Face scanner to detect terrorist or criminal
008 Emergency services call list
009 Collision radar (Airplane, car, etc.)
100 Building ventilation duct
110 Kitchen hood ventilation duct
120 Mad Shooter Other options according to needs and future technologies All other system components have a number or number with letter that gives their assigned decimal identification to the system The components send their decimal values to the secondary panels.

The secondary panels translate the decimal value into binary code for sending to the primary panel.

The main panel, as well as the server, create the escape route and perform other system functions.

Stages of the intended order of the algorithm are shown in FIG. 10 and they are as follows:

1: When an alarm is triggered, all system components send the first code to be received to the secondary panel. Green or red.

2: All elevators are stopped at the next level. The fire alarm signals occupants to leave the building. The elevator doors close and the elevators stay in place.

3: Each component that has a green signal is identified with their decimal value.

4: Location of each component.

5: Verification of the count of each person on the floors or in the building.

6: Present the correct path for a quick escape.

7: Verification of the decrease m occupants in the building.

8: Triggering of sprinklers in stairwells or given path to protect the exit of people.

Example of the Expected Order of the Algorithm (00 or 01 green or red)
(02 elevator)
(Digits of the triggered component which are green)
(14 locations of each component)
(7 or 7A or 7B, Counter of people who are in the building, entry, exit)
(11 Evacuation given with a safe route)
(7 or 7A or 7B, Counter of people who are in the building, entry, exit)
(6 nozzles)

EXAMPLES 00002114214614314814614514711 76

The components transmit these digits of decimal value to the secondary panels.

The secondary panels send to the main panel and server which transform them into binary code for the server to understand.

0011000000110000001100000011001000110001001100010100011010000110010001100010010101000011011000110001001100110011000100-1101000011100000110001001101000 0110110001100010011010000110101001100010011010 0-0011011100110001001100010011011 10

What the server receives and analyzes is sent back in the opposite direction to give the correct escape route.

Then the server sends the order of the safest escape route to the secondary panels, depending on the signal from the nearest components that gave a green signal 0011000000110000001100000011001000110001001100 10-1000011100100110001001101000010010001100010011010000-1101110011000100110100001110000 0110001001101000011100100110001001101000011000 1-0011000100110100

System Decimal Value 0002149142145147148149141 14 which is the safest route identified by the server.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

The invention claimed is:

1. A method of operation implemented by an integrated fire and emergency management system of a building with a plurality of elevators and a plurality of floors, the system comprises:

a plurality of system components, a secondary panel, a primary panel and a server;

wherein each of the plurality of system components has a number or number with letter represents a decimal value that corresponds to an assigned decimal identification to the system;

the plurality of system components are configured to send their corresponding decimal values to the secondary panel;

the secondary panel translates the decimal values into binary codes for sending to the primary panel;

one of the primary panel and the server is configured to create an escape route;

the method consisting steps of:

a) when a fire alarm is triggered, sending the decimal values of all the plurality of system components to be received to the secondary panel, wherein the decimal values comprise green signal or red signal;

b) stopping all the elevators at next level when the fire alarm signals occupants within the building to leave the building, and closing all doors of the elevators and commanding the elevators to stay in place;

c) identifying each of the plurality of system components that has a green signal with its respective decimal value;

d) determining location of each of the system components;

e) verifying number of occupants on the floors or in the building;

f) presenting the escape route for a quick escape;

g) verifying decrease in occupants in the building;

h) triggering of sprinklers in stairwells of the building or at the escaped route to protect exit of the occupants.

* * * * *